US012251061B2

(12) United States Patent
Clements et al.

(10) Patent No.: US 12,251,061 B2
(45) Date of Patent: Mar. 18, 2025

(54) BEHAVIOR CONTROL OF MOBILE CLEANING ROBOT

(71) Applicant: iRobot Corporation, Bedford, MA (US)

(72) Inventors: Matthew Clements, Pasadena, CA (US); Varun Malhotra, Cambridge, MA (US); Landon Unninayar, Waltham, MA (US); Brian Cleve Benson, Jr., Chelmsford, MA (US); Andrew Graziani, Portsmouth, NH (US); Shiwei Wang, Nashua, NH (US); Thomas C. Chang, Lexington, MA (US); Dan Wivagg, Westford, MA (US)

(73) Assignee: iRobot Corporation, Bedford, MA (US)

( * ) Notice: Subject to any disclaimer, the term of this patent is extended or adjusted under 35 U.S.C. 154(b) by 339 days.

(21) Appl. No.: 17/947,376

(22) Filed: Sep. 19, 2022

(65) Prior Publication Data

US 2024/0090733 A1 Mar. 21, 2024

(51) Int. Cl.

| | |
|---|---|
| ***A47L 9/00*** | (2006.01) |
| ***A47L 11/30*** | (2006.01) |
| ***A47L 11/40*** | (2006.01) |

(52) U.S. Cl.

CPC ..... *A47L 11/4011* (2013.01); *A47L 11/30* (2013.01); *A47L 11/4061* (2013.01); *A47L 2201/04* (2013.01); *A47L 2201/06* (2013.01)

(58) Field of Classification Search

CPC .... B25J 9/0003; B25J 9/1694; A47L 11/4011; A47L 11/30; A47L 11/4061; A47L 2201/04; A47L 2201/06

See application file for complete search history.

(56) References Cited

U.S. PATENT DOCUMENTS

| | | | | |
|---|---|---|---|---|
| 9,766,627 | B2 * | 9/2017 | Jägenstedt et al. | G01L 5/0052 |
| 2017/0156560 | A1 * | 6/2017 | Jung | A47L 9/2884 |
| 2018/0078106 | A1 * | 3/2018 | Scholten | A47L 9/009 |
| 2019/0069744 | A1 * | 3/2019 | Liggett | A47L 9/2805 |
| 2020/0225673 | A1 | 7/2020 | Ebrahimi Afrouzi et al. | |
| 2022/0104677 | A1 | 4/2022 | Sack et al. | |
| 2022/0142444 | A1 | 5/2022 | Xie et al. | |
| 2024/0148215 | A1 * | 5/2024 | Li | A47L 11/4066 |

OTHER PUBLICATIONS

"International Application Serial No. PCT US2023 033010, International Search Report mailed Jan. 8, 2024", 3 pgs.
"International Application Serial No. PCT US2023 033010, Written Opinion mailed Jan. 8, 2024", 8 pgs.

* cited by examiner

*Primary Examiner* — Dalena Tran
(74) *Attorney, Agent, or Firm* — Schwegman Lundberg & Woessner, P.A.

(57) ABSTRACT

A method of operating a mobile cleaning robot can include navigating the mobile cleaning robot within an environment. Whether a movement condition is satisfied can be determined and a mopping pad tray can be moved relative to a body of the mobile cleaning robot between a cleaning position and a stored position in response to receipt of a command to move the mopping pad tray when the movement condition is satisfied.

16 Claims, 12 Drawing Sheets

BEHAVIOR CONTROL OF MOBILE CLEANING ROBOT

BACKGROUND

Autonomous mobile robots can move about an environment and can perform functions and operations in a variety of categories, including but not limited to security operations, infrastructure or maintenance operations, navigation or mapping operations, inventory management operations, and robot/human interaction operations. Some mobile robots, known as cleaning robots, can perform cleaning tasks autonomously within an environment, e.g., a home. Many kinds of cleaning robots are autonomous to some degree and in different ways. For example, some mobile cleaning robots can perform both vacuuming and mopping operations or routines.

SUMMARY

A mobile cleaning robot can be an autonomous robot that is at least partially controlled locally (e.g. via controls on the robot) or remotely (e.g. via a remote handheld device) to move about an environment. One or more processors within the mobile cleaning robot can receive signals from various sensors of the robot. The processor(s) can use the signals to control movement of the robot within the environment as well as various routines such as cleaning routines or portions thereof. Mobile cleaning robots that include a movable mopping pad can require additional monitoring to help ensure the mobile cleaning robot functions properly during a cleaning mission.

The devices, systems, or methods of this application can help to address this issue by including a processor configured limit mopping related routines performed by the mobile cleaning robot based on conditions detected using one or more sensor signals. For example, when the processor determines that a movement condition of the mobile cleaning robot is not satisfied, the processor can limit movement of the mopping pad assembly, helping to ensure missions can be completed.

In one example, a method of operating a mobile cleaning robot can include navigating the mobile cleaning robot within an environment. Whether a movement condition is satisfied can be determined and a mopping pad tray can be moved relative to a body of the mobile cleaning robot between a cleaning position and a stored condition in response to receipt of a command to move the mopping pad tray when the movement condition is satisfied.

The above discussion is intended to provide an overview of subject matter of the present patent application. It is not intended to provide an exclusive or exhaustive explanation of the invention. The description below is included to provide further information about the present patent application.

BRIEF DESCRIPTION OF THE DRAWINGS

Various embodiments are illustrated by way of example in the figures of the accompanying drawings. Such embodiments are demonstrative and not intended to be exhaustive or exclusive embodiments of the present subject matter.

DETAILED DESCRIPTION

Robot Operation Summary

Figure 1:
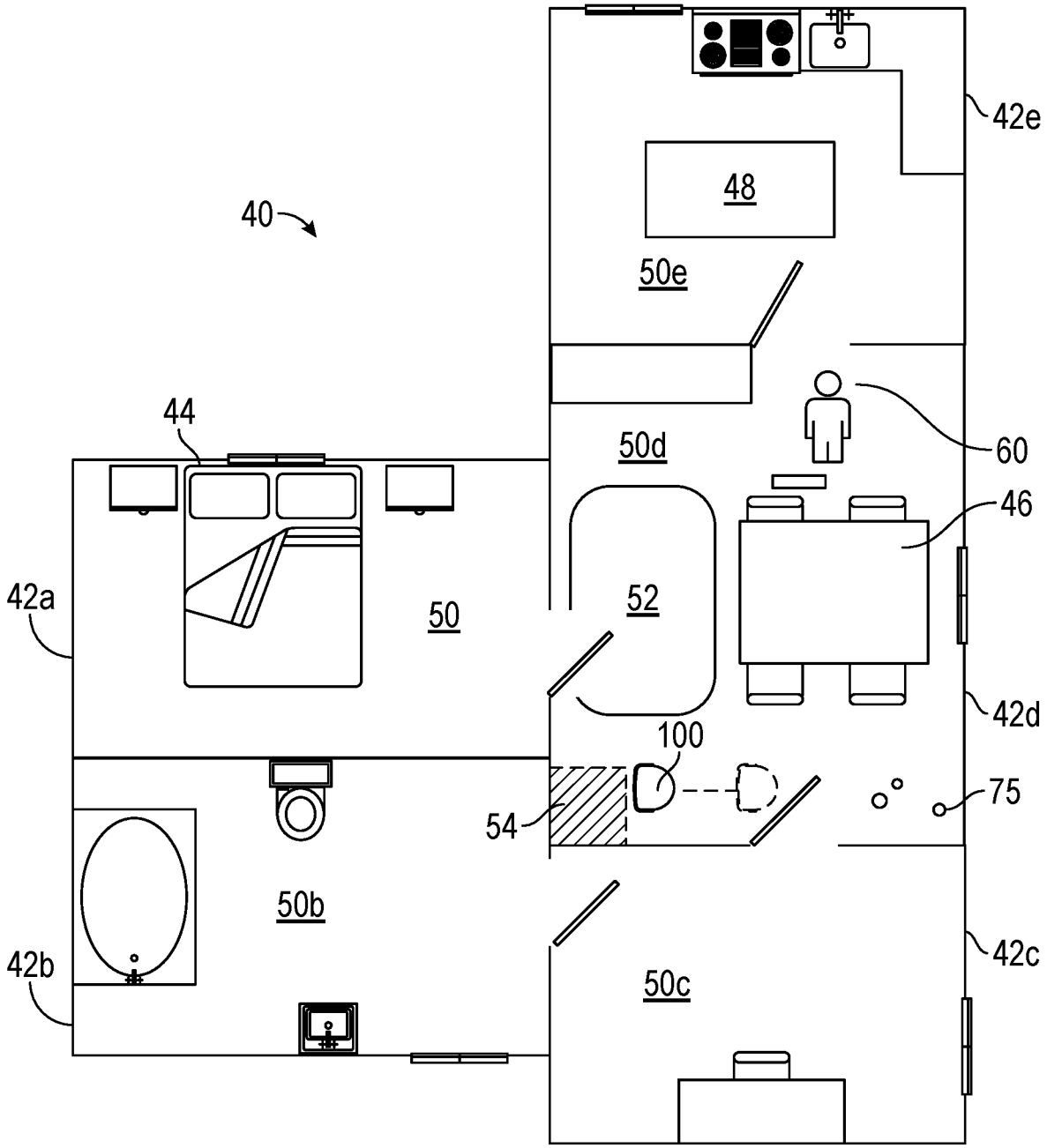
FIG. 1 illustrates a plan view of a mobile cleaning robot in an environment.

FIG. 1 illustrates a plan view of a mobile cleaning robot 100 in an environment 40, in accordance with at least one example of this disclosure. The environment 40 can be a dwelling, such as a home or an apartment, and can include rooms 42*a*-42*e*. Obstacles, such as a bed 44, a table 46, and an island 48 can be located in the rooms 42 of the environment. Each of the rooms 42*a*-42*e* can have a floor surface 50*a*-50*e*, respectively. Some rooms, such as the room 42*d*, can include a rug, such as a rug 52. The floor surfaces 50 can be of one or more types such as hardwood, ceramic, low-pile carpet, medium-pile carpet, long (or high)-pile carpet, stone, or the like.

The mobile cleaning robot 100 can be operated, such as by a user 60, to autonomously clean the environment 40 in a room-by-room fashion. In some examples, the robot 100 can clean the floor surface 50*a* of one room, such as the room 42*a*, before moving to the next room, such as the room 42*d*, to clean the surface of the room 42*d*. Different rooms can have different types of floor surfaces. For example, the room 42*e* (which can be a kitchen) can have a hard floor surface, such as wood or ceramic tile, and the room 42*a* (which can be a bedroom) can have a carpet surface, such as a medium pile carpet. Other rooms, such as the room 42*d* (which can be a dining room) can include multiple surfaces where the rug 52 is located within the room 42*d*.

During cleaning or traveling operations, the robot 100 can use data collected from various sensors (such as optical sensors) and calculations (such as odometry and obstacle detection) to develop a map of the environment 40. Once the map is created, the user 60 can define rooms or zones (such as the rooms 42) within the map. The map can be presentable to the user 60 on a user interface, such as a mobile device, where the user 60 can direct or change cleaning preferences, for example.

Also, during operation, the robot 100 can detect surface types within each of the rooms 42, which can be stored in the robot 100 or another device. The robot 100 can update the map (or data related thereto) such as to include or account for surface types of the floor surfaces 50*a*-50*e* of each of the respective rooms 42 of the environment 40. In some examples, the map can be updated to show the different surface types such as within each of the rooms 42.

In some examples, the user 60 can define a behavior control zone 54. In autonomous operation, the robot 100 can initiate a behavior in response to being in or near the behavior control zone 54. For example, the user 60 can define an area of the environment 40 that is prone to becoming dirty to be the behavior control zone 54. In response, the robot 100 can initiate a focused cleaning behavior in which the robot 100 performs a focused cleaning of a portion of the floor surface 50*d* in the behavior control zone 54.

Robot Example

Figure 2A:
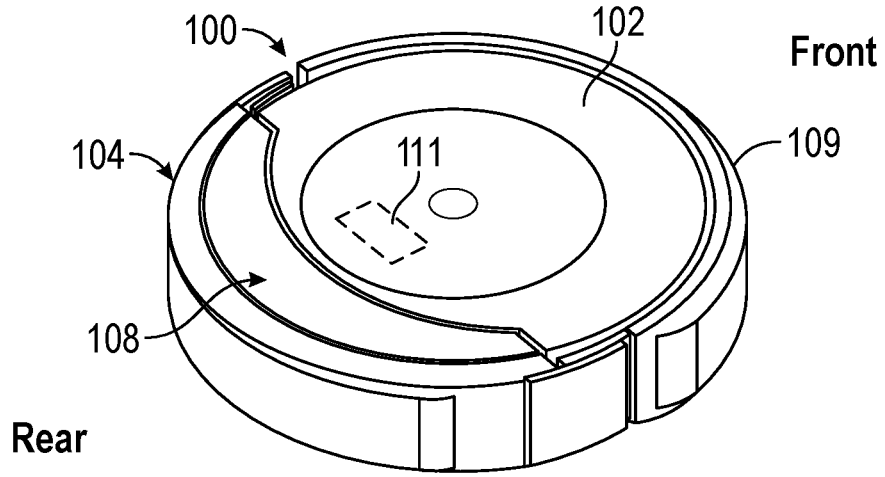
FIG. 2A illustrates an isometric view of a mobile cleaning robot in a first condition.
Figure 2B:
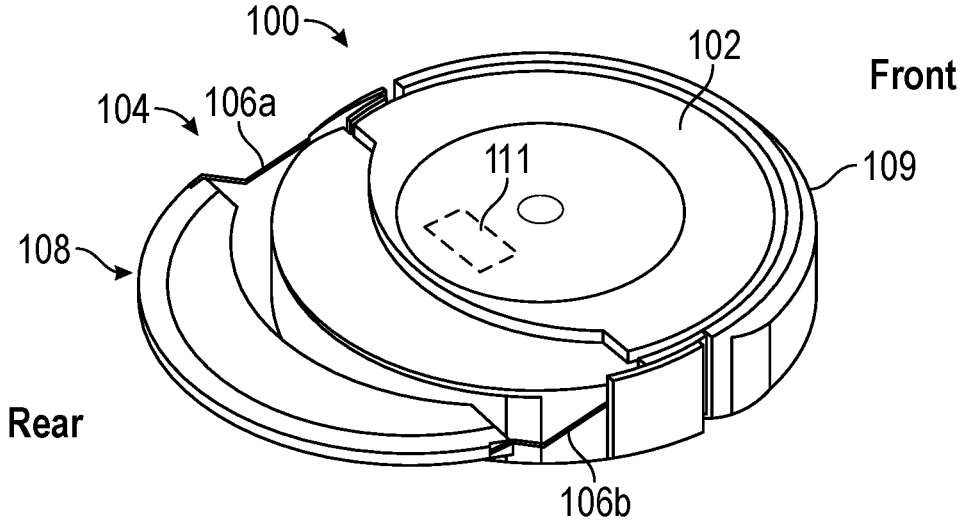
FIG. 2B illustrates an isometric view of a mobile cleaning robot in a second condition.
Figure 2C:
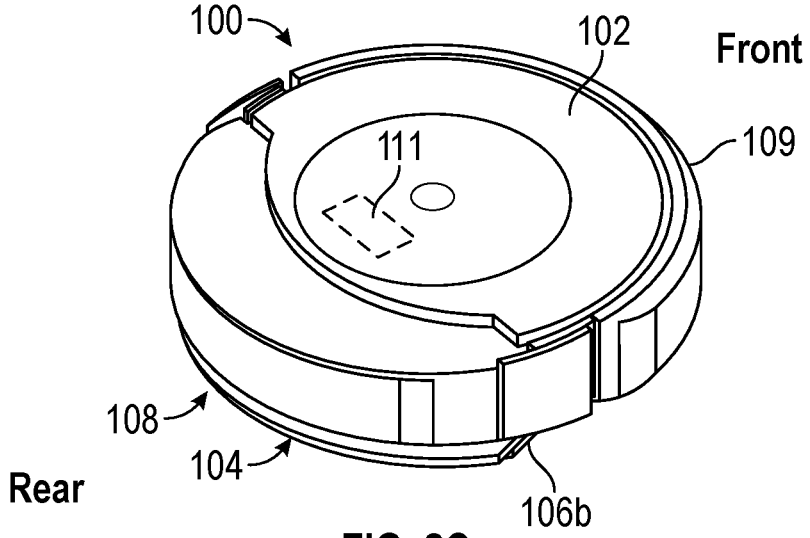
FIG. 2C illustrates an isometric view of a mobile cleaning robot in a third condition.

FIG. 2A illustrates an isometric view of a mobile cleaning robot 100 with a pad assembly in a stored position. FIG. 2B illustrates an isometric view of the mobile cleaning robot 100 with the pad assembly in an extended position. FIG. 2C illustrates an isometric view of the mobile cleaning robot 100 with the pad assembly in a mopping position. FIGS. 2A-2C also show orientation indicators Front and Rear. FIGS. 2A-2C are discussed together below.

The mobile cleaning robot 100 can include a body 102 and a mopping system 104. The mopping system 104 can include arms 106*a* and 106*b* (referred to together as arms 106) and a pad assembly 108. The robot 100 can also include a bumper 109 and other features such as an extractor (including rollers), one or more side brushes, a vacuum system, a controller, a drive system (e.g., motor, geartrain, and wheels), a caster, and sensors, as discussed in further detail below. A distal portion of the arms 106 can be connected to the pad assembly 108 and a proximal portion of the arms 106*a* and 106*b* can be connected to an internal drive system to drive the arms 106 to move the pad assembly 108.

Figure 2D:
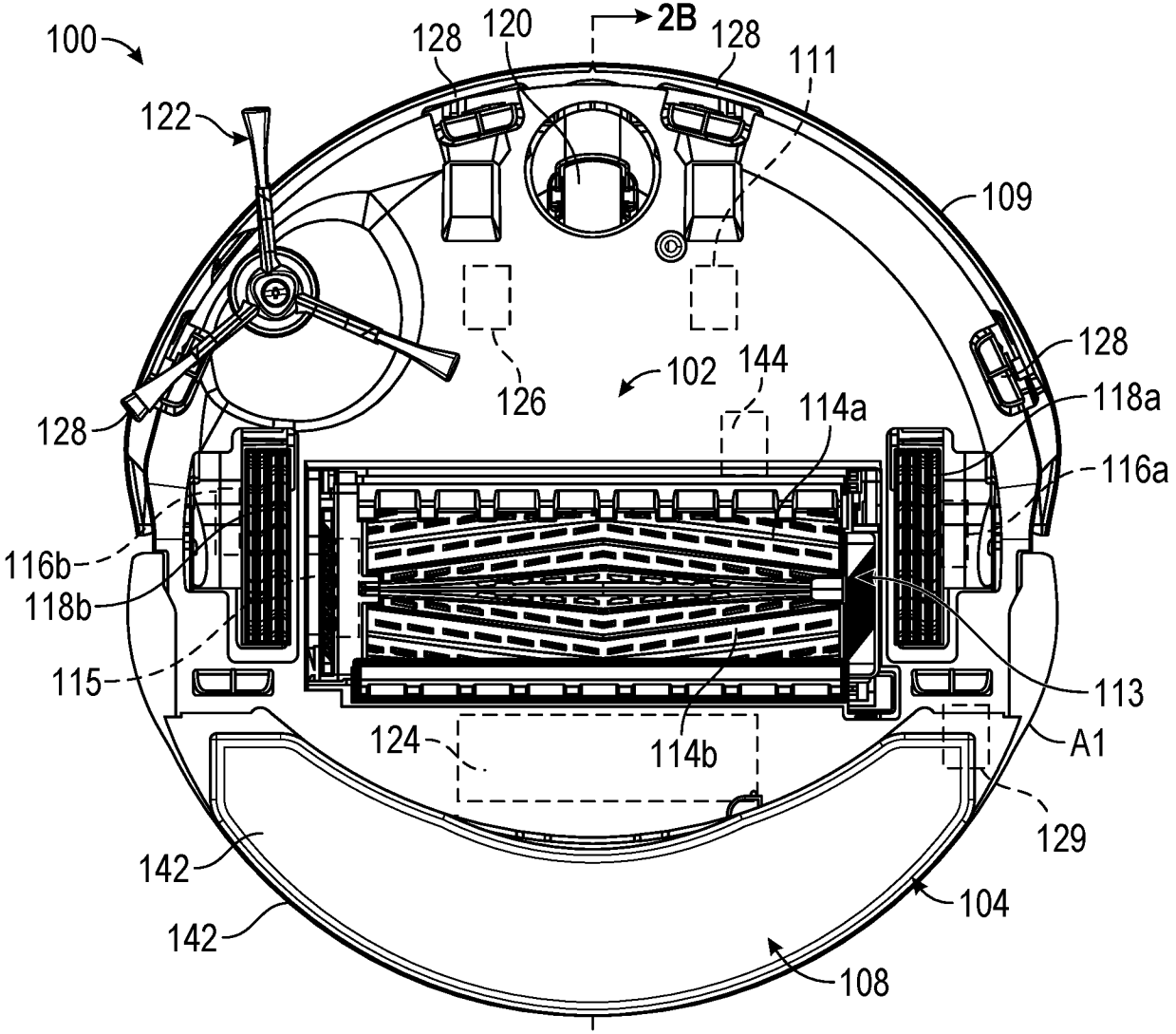
FIG. 2D illustrates a bottom view of a mobile cleaning robot in a third condition.
Figure 2E:
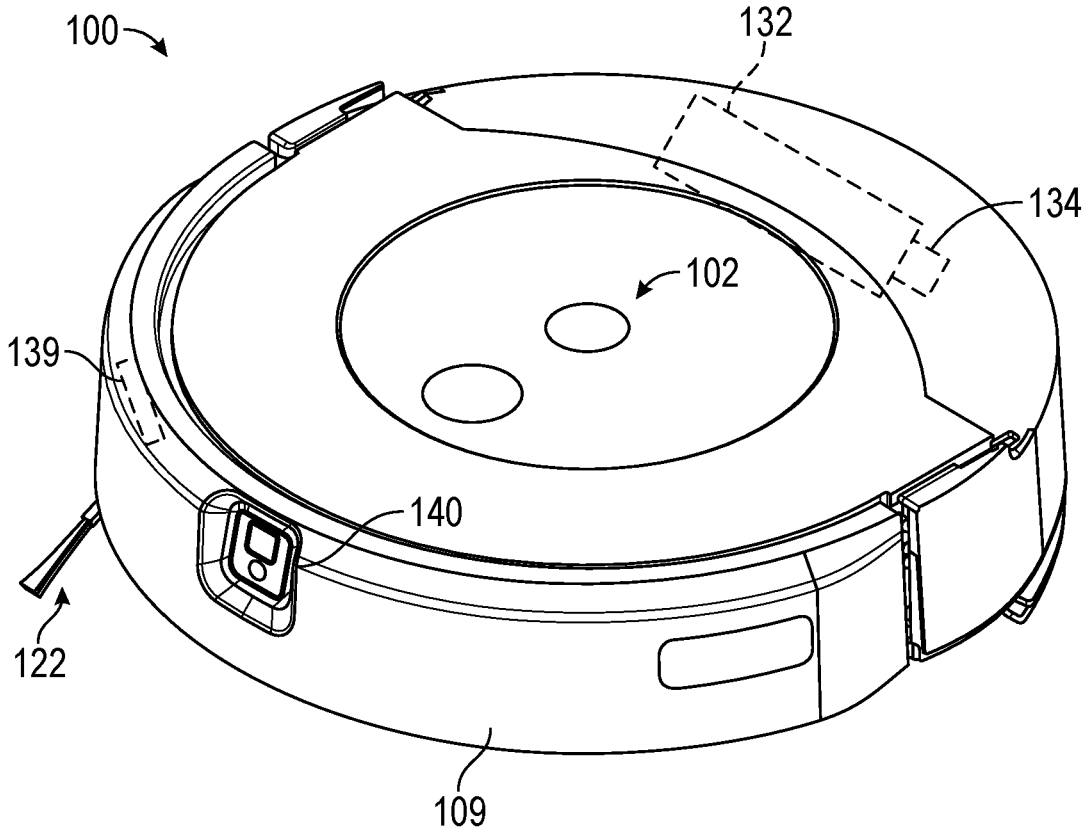
FIG. 2E illustrates a top isometric view of a mobile cleaning robot in a third condition.

FIGS. 2A-2C show how the robot 100 can be operated to move the pad assembly 108 from a stored position in FIG. 2A to a transition or partially deployed position in FIG. 2B, to a mopping or a deployed position in FIG. 2C. In the stored position of FIG. 2A, the robot 100 can perform only vacuuming operations. In the deployed position of FIG. 2C, the robot 100 can perform vacuuming operations or mopping operations. FIGS. 2D-2E discuss additional components of the robot 100.

Components of the Robot

FIG. 2D illustrates a bottom view of the mobile cleaning robot 100 and FIG. 2E illustrates a top isometric view of the robot 100. FIGS. 2D and 2E are discussed together below. The robot 100 of FIGS. 2D and 2E can be consistent with FIGS. 2A-2C; FIGS. 2D-2E show additional details of the robot 100 For example, FIGS. 2D-2E show that the robot 100 can include a body 102, a bumper 109, an extractor 113 (including rollers 114*a* and 114*b*), motors 116*a* and 116*b*, drive wheels 118*a* and 118*b*, a caster 120, a side brush assembly 122, a vacuum assembly 124, memory 126, sensors 128, and a debris bin 130. The mopping system 104 can also include a tank 132 and a pump 134.

The cleaning robot 100 can be an autonomous cleaning robot that autonomously traverses the floor surface 50 (of FIG. 1) while ingesting the debris from different parts of the floor surface 50. As shown in FIG. 2D, the robot 100 can include the body 102 that can be movable across the floor surface 50. The body 102 can include multiple connected structures to which movable or fixed components of the cleaning robot 100 are mounted. The connected structures can include, for example, an outer housing to cover internal components of the cleaning robot 100, a chassis to which the drive wheels 118*a* and 118*b* and the cleaning rollers 114*a* and 114*b* (of the cleaning assembly 113) are mounted, and the bumper 109 connected to the outer housing. The caster wheel 120 can support the front portion of the body 102 above the floor surface 50, and the drive wheels 118*a* and 118*b* can support the middle and rear portions of the body 102 (and can also support a majority of the weight of the robot 100) above the floor surface 50.

As shown in FIG. 2D, the body 102 can include a front portion that can have a substantially semicircular shape and that can be connected to the bumper 109. The body 102 can also include a rear portion that has a substantially semicircular shape. In other examples, the body 102 can have other shapes such as a square front or straight front. The robot 100 can also include a drive system including the actuators (e.g., motors) 116*a* and 116*b*. The actuators 116*a* and 116*b* can be connected to the body 102 and can be operably connected to the drive wheels 118*a* and 118*b*, which can be rotatably mounted to the body 102. The actuators 116*a* and 116*b*, when driven, can rotate the drive wheels 118*a* and 118*b* to enable the robot 100 to autonomously move across the floor surface 50.

The vacuum assembly 124 can be located at least partially within the body 102 of the robot 100, such as in a rear portion of the body 102, and can be located in other locations in other examples. The vacuum assembly 124 can include a motor to drive an impeller that generates the airflow when rotated. The airflow and the cleaning rollers 114, when rotated, can cooperate to ingest the debris into the robot 100. The cleaning bin 130 can be mounted in the body 102 and can contain the debris ingested by the robot 100. A filter in the body 102 can separate the debris from the airflow before the airflow enters the vacuum assembly 124 and is exhausted out of the body 102. In this regard, the debris can be captured in both the cleaning bin 130 and the filter before the airflow is exhausted from the body 102. In some examples, the vacuum assembly 124 and extractor 113 can be optionally included or can be of a different type. Optionally, the vacuum assembly 124 can be operated during mopping operations, such as those including the mopping system 104. That is, the robot 100 can perform simultaneous vacuuming and mopping missions or operations.

The cleaning rollers 114*a* and 114*b* can be operably connected to an actuator 115, e.g., a motor, through a gearbox. The cleaning head 113 and the cleaning rollers 114*a* and 114*b* can be positioned forward of the cleaning bin 130. The cleaning rollers 114 can be mounted to an underside of the body 102 so that the cleaning rollers 114*a* and 114*b* engage debris on the floor surface 50 during the cleaning operation when the underside of the body 102 faces the floor surface 50. FIG. 2D further shows that the pad assembly 108 can include a brake 129 that can be configured to engage a portion of the pad assembly 108 to limit movement or motion of a mopping pad 142 (and a pad tray 141 to which the mopping pad 142 is connected) with respect to the body 102.

The controller 111 can be located within the housing 102 and can be a programmable controller, such as a single or multi-board computer, a direct digital controller (DDC), a programmable logic controller (PLC), or the like. In other examples, the controller 111 can be any computing device, such as a handheld computer, for example, a smart phone, a tablet, a laptop, a desktop computer, or any other computing device including a processor, memory, and communication capabilities. The memory 126 can be one or more types of memory, such as volatile or non-volatile memory, read-only memory (ROM), random-access memory (RAM), magnetic disk storage media, optical storage media, flash-memory devices, and other storage devices and media. The memory 126 can be located within the housing 102, connected to the controller 111 and accessible by the controller 111.

The controller 111 can operate the actuators 116*a* and 116*b* to autonomously navigate the robot 100 about the floor surface 50 during a cleaning operation. The actuators 116*a* and 116*b* can be operable to drive the robot 100 in a forward drive direction, in a backwards direction, and to turn the robot 100. The controller 111 can operate the vacuum assembly 124 to generate an airflow that flows through an air gap near the cleaning rollers 114, through the body 102, and out of the body 102.

The control system can further include a sensor system with one or more electrical sensors. The sensor system, as described herein, can generate a signal indicative of a current location of the robot 100, and can generate signals indicative of locations of the robot 100 as the robot 100 travels along the floor surface 50. The sensors 128 (shown in FIG. 2A) can be located along a bottom portion of the housing 102. Each of the sensors 128 can be an optical sensor that can be configured to detect a presence or absence of an object below the optical sensor, such as the floor surface 50. The sensors 128 (optionally cliff sensors) can be connected to the controller 111 and can be used by the controller 111 to navigate the robot 100 within the environment 40. In some examples, the cliff sensors can be used to detect a floor surface type which the controller 111 can use to selectively operate the mopping system 104.

The cleaning pad assembly 108 can be a cleaning pad connected to the bottom portion of the body 102 (or connected to a moving mechanism configured to move the assembly 108 between a stored position and a cleaning position), such as to the cleaning bin 130 in a location to the rear of the extractor 113. The tank 132 can be a water tank configured to store water or fluid, such as cleaning fluid, for delivery to a mopping pad 142. The pump 134 can be connected to the controller 111 and can be in fluid communication with the tank 132. The controller 111 can be configured to operate the pump 134 to deliver fluid to the mopping pad 142 during mopping operations. In some examples, the pad 142 can be a dry pad such as for dusting or dry debris removal. The pad 142 can also be any cloth, fabric, or the like configured for cleaning (either wet or dry) of a floor surface.

Operation of the Robot

In operation of some examples, the controller 111 can be used to instruct the robot 100 to perform a mission. In such a case, the controller 111 can operate the motors 116 to drive the drive wheels 118 and propel the robot 100 along the floor surface 50. The robot 100 can be propelled in a forward drive direction or a rearward drive direction. The robot 100 can also be propelled such that the robot 100 turns in place or turns while moving in the forward drive direction or the rearward drive direction. In addition, the controller 111 can operate the motors 115 to cause the rollers 114*a* and 114*b* to rotate, can operate the side brush assembly 122, and can operate the motor of the vacuum system 124 to generate airflow. The controller 111 can execute software stored on the memory 126 to cause the robot 100 to perform various navigational and cleaning behaviors by operating the various motors of the robot 100.

The various sensors of the robot 100 can be used to help the robot navigate and clean within the environment 40. For example, the cliff sensors can detect obstacles such as drop-offs and cliffs below portions of the robot 100 where the cliff sensors are disposed. The cliff sensors can transmit signals to the controller 111 so that the controller 111 can redirect the robot 100 based on signals from the sensors.

Proximity sensors can produce a signal based on a presence or the absence of an object in front of the optical sensor. For example, detectable objects include obstacles such as furniture, walls, persons, and other objects in the environment 40 of the robot 100. The proximity sensors can transmit signals to the controller 111 so that the controller 111 can redirect the robot 100 based on signals from the proximity sensors. In some examples, a bump sensor can be used to detect movement of the bumper 109 along a fore-aft axis of the robot 100. A bump sensor 139 can also be used to detect movement of the bumper 109 along one or more sides of the robot 100 and can optionally detect vertical bumper movement. The bump sensors 139 can transmit signals to the controller 111 so that the controller 111 can redirect the robot 100 based on signals from the bump sensors 139.

The robot 100 can also optionally include one or more dirt sensors 144 connected to the body 102 and in communication with the controller 111. The dirt sensors 144 can be a microphone, piezoelectric sensor, optical sensor, or the like located in or near a flowpath of debris, such as near an opening of the cleaning rollers 114 or in one or more ducts within the body 102. This can allow the dirt sensor(s) 144 to detect how much dirt is being ingested by the vacuum assembly 124 (e.g., via the extractor 113) at any time during a cleaning mission. Because the robot 100 can be aware of its location, the robot 100 can keep a log or record of which areas or rooms of the map are dirtier or where more dirt is collected. This information can be used in several ways, as discussed further below.

The image capture device 140 can be configured to generate a signal based on imagery of the environment 40 of the robot 100 as the robot 100 moves about the floor surface 50. The image capture device 140 can transmit such a signal to the controller 111. The controller 111 can use the signal or signals from the image capture device 140 for various tasks, algorithms, or the like, as discussed in further detail below.

In some examples, the obstacle following sensors can detect detectable objects, including obstacles such as furniture, walls, persons, and other objects in the environment of the robot 100. In some implementations, the sensor system can include an obstacle following sensor along the side surface, and the obstacle following sensor can detect the presence or the absence an object adjacent to the side surface. The one or more obstacle following sensors can also serve as obstacle detection sensors, similar to the proximity sensors described herein.

The robot 100 can also include sensors for tracking a distance travelled by the robot 100. For example, the sensor system can include encoders associated with the motors 116 for the drive wheels 118, and the encoders can track a distance that the robot 100 has travelled. In some implementations, the sensor can include an optical sensor facing downward toward a floor surface. The optical sensor can be positioned to direct light through a bottom surface of the robot 100 toward the floor surface 50. The optical sensor can detect reflections of the light and can detect a distance travelled by the robot 100 based on changes in floor features as the robot 100 travels along the floor surface 50.

The controller 111 can use data collected by the sensors of the sensor system to control navigational behaviors of the robot 100 during the mission. For example, the controller 111 can use the sensor data collected by obstacle detection sensors of the robot 100, (the cliff sensors, the proximity sensors, and the bump sensors) to enable the robot 100 to avoid obstacles within the environment of the robot 100 during the mission.

The sensor data can also be used by the controller 111 for simultaneous localization and mapping (SLAM) techniques in which the controller 111 extracts features of the environment represented by the sensor data and constructs a map of the floor surface 50 of the environment. The sensor data collected by the image capture device 140 can be used for techniques such as vision-based SLAM (VSLAM) in which the controller 111 extracts visual features corresponding to objects in the environment 40 and constructs the map using these visual features. As the controller 111 directs the robot 100 about the floor surface 50 during the mission, the controller 111 can use SLAM techniques to determine a location of the robot 100 within the map by detecting features represented in collected sensor data and comparing the features to previously stored features. The map formed from the sensor data can indicate locations of traversable and nontraversable space within the environment. For example, locations of obstacles can be indicated on the map as nontraversable space, and locations of open floor space can be indicated on the map as traversable space.

The sensor data collected by any of the sensors can be stored in the memory 126. In addition, other data generated for the SLAM techniques, including mapping data forming the map, can be stored in the memory 126. These data produced during the mission can include persistent data that are produced during the mission and that are usable during further missions. In addition to storing the software for causing the robot 100 to perform its behaviors, the memory 126 can store data resulting from processing of the sensor data for access by the controller 111. For example, the map can be a map that is usable and updateable by the controller 111 of the robot 100 from one mission to another mission to navigate the robot 100 about the floor surface 50.

The persistent data, including the persistent map, can help to enable the robot 100 to efficiently clean the floor surface 50. For example, the map can enable the controller 111 to direct the robot 100 toward open floor space and to avoid nontraversable space. In addition, for subsequent missions, the controller 111 can use the map to optimize paths taken during the missions to help plan navigation of the robot 100 through the environment 40.

The controller 111 can also send commands to a motor (internal to the body 102) to drive the arms 106 to move the pad assembly 108 between the stored position (shown in FIGS. 2A and 2D) and the deployed position (shown in FIGS. 2C and 2E). In the deployed position, the pad assembly 108 (the mopping pad 142) can be used to mop a floor surface of any room of the environment 40.

The mopping pad 142 can be a dry pad or a wet pad. Optionally, when the mopping pad 142 is a wet pad, the pump 134 can be operated by the controller 111 to spray or drop fluid (e.g., water or a cleaning solution) onto the floor surface 50 or the mopping pad 142. The wetted mopping pad 142 can then be used by the robot 100 to perform wet mopping operations on the floor surface 50 of the environment 40. As discussed in further detail below, the controller 111 can determine when to move the pad tray 141 and the mopping pad 142 between the stored position and the cleaning position.

Network Examples

Figure 3:
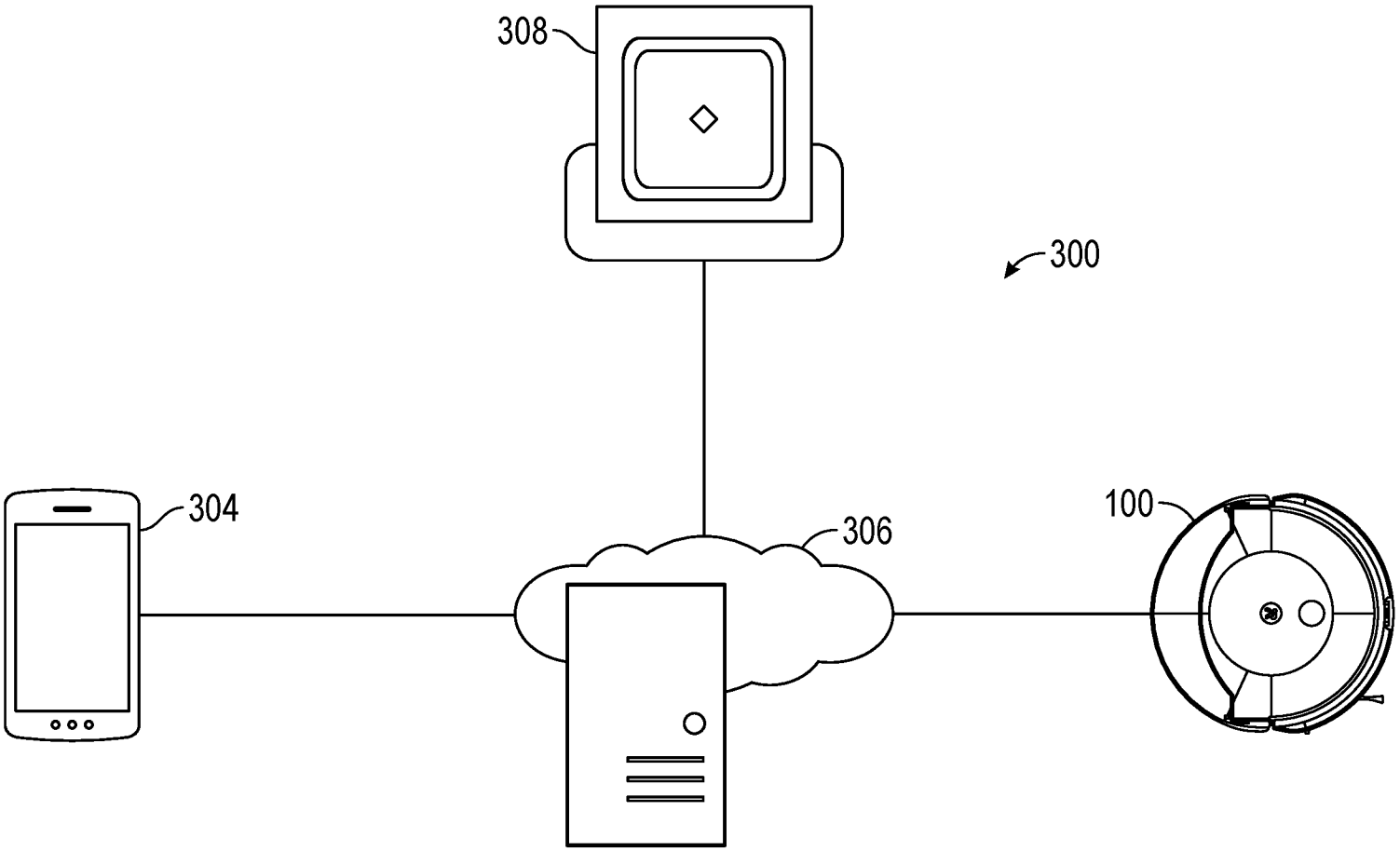
FIG. 3 illustrates a diagram illustrating an example of a communication network in which a mobile cleaning robot operates and data transmission in the network.

FIG. 3 is a diagram illustrating by way of example and not limitation a communication network 300 that enables networking between the mobile robot 100 and one or more other devices, such as a mobile device 304 (including a controller), a cloud computing system 306 (including a controller), or another autonomous robot 308 separate from the mobile robot 100. Using the communication network 300, the robot 100, the mobile device 100, the robot 308, and the cloud computing system 306 can communicate with one another to transmit and receive data from one another. In some examples, the robot 100, the robot 308, or both the robot 100 and the robot 308 communicate with the mobile device 304 through the cloud computing system 306. Alternatively, or additionally, the robot 100, the robot 308, or both the robot 100 and the robot 308 communicate directly with the mobile device 304. Various types and combinations of wireless networks (e.g., Bluetooth, radio frequency, optical based, etc.) and network architectures (e.g., wi-fi or mesh networks) can be employed by the communication network 300.

In some examples, the mobile device 304 can be a remote device that can be linked to the cloud computing system 306 and can enable a user to provide inputs. The mobile device 304 can include user input elements such as, for example, one or more of a touchscreen display, buttons, a microphone, a mouse, a keyboard, or other devices that respond to inputs provided by the user. The mobile device 304 can also include immersive media (e.g., virtual reality) with which the user can interact to provide input. The mobile device 304, in these examples, can be a virtual reality headset or a head-mounted display.

The user can provide inputs corresponding to commands for the mobile robot 100. In such cases, the mobile device 304 can transmit a signal to the cloud computing system 306 to cause the cloud computing system 306 to transmit a command signal to the mobile robot 100. In some implementations, the mobile device 304 can present augmented reality images. In some implementations, the mobile device 304 can be a smart phone, a laptop computer, a tablet computing device, or other mobile device.

According to some examples discussed herein, the mobile device 304 can include a user interface configured to display a map of the robot environment. A robot path, such as that identified by a coverage planner, can also be displayed on the map. The interface can receive a user instruction to modify the environment map, such as by adding, removing, or otherwise modifying a keep-out zone in the environment; adding, removing, or otherwise modifying a focused cleaning zone in the environment (such as an area that requires repeated cleaning); restricting a robot traversal direction or traversal pattern in a portion of the environment; or adding or changing a cleaning rank, among others.

In some examples, the communication network 300 can include additional nodes. For example, nodes of the communication network 300 can include additional robots. Also, nodes of the communication network 300 can include network-connected devices that can generate information about the environment 20. Such a network-connected device can include one or more sensors, such as an acoustic sensor, an image capture system, or other sensor generating signals, to detect characteristics of the environment 40 from which features can be extracted. Network-connected devices can also include home cameras, smart sensors, or the like.

In the communication network 300, the wireless links can utilize various communication schemes, protocols, etc., such as, for example, Bluetooth classes, Wi-Fi, Bluetooth-low-energy, also known as BLE, 802.15.4, Worldwide Interoperability for Microwave Access (WiMAX), an infrared channel, satellite band, or the like. In some examples, wireless links can include any cellular network standards used to communicate among mobile devices, including, but not limited to, standards that qualify as 1G, 2G, 3G, 4G, 5G, or the like. The network standards, if utilized, qualify as, for example, one or more generations of mobile telecommunication standards by fulfilling a specification or standards such as the specifications maintained by International Telecommunication Union. For example, the 4G standards can correspond to the International Mobile Telecommunications Advanced (IMT-Advanced) specification. Examples of cellular network standards include AMPS, GSM, GPRS, UMTS, LTE, LTE Advanced, Mobile WiMAX, and WiMAX-Advanced. Cellular network standards can use various channel access methods, e.g., FDMA, TDMA, CDMA, or SDMA.

Behavior Control Examples

FIGS. 4-10 show various methods of operating a mobile cleaning robot during a mission in an environment. The processors or controllers discussed below can be one or more of the controller 111 (or another controller of the robot 100), a controller of the mobile device 304, a controller of the cloud computing system 306, or a controller of the robot 308.

Figure 4:
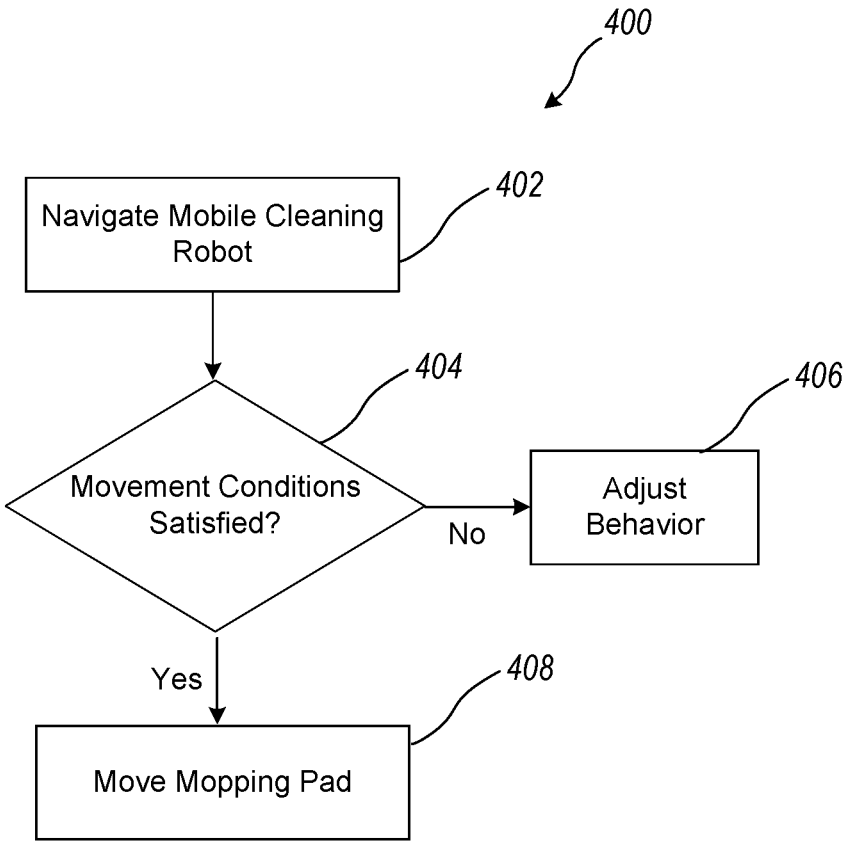
FIG. 4 illustrates a schematic view of a method of operating one or more systems or devices discussed herein.
Figure 5:
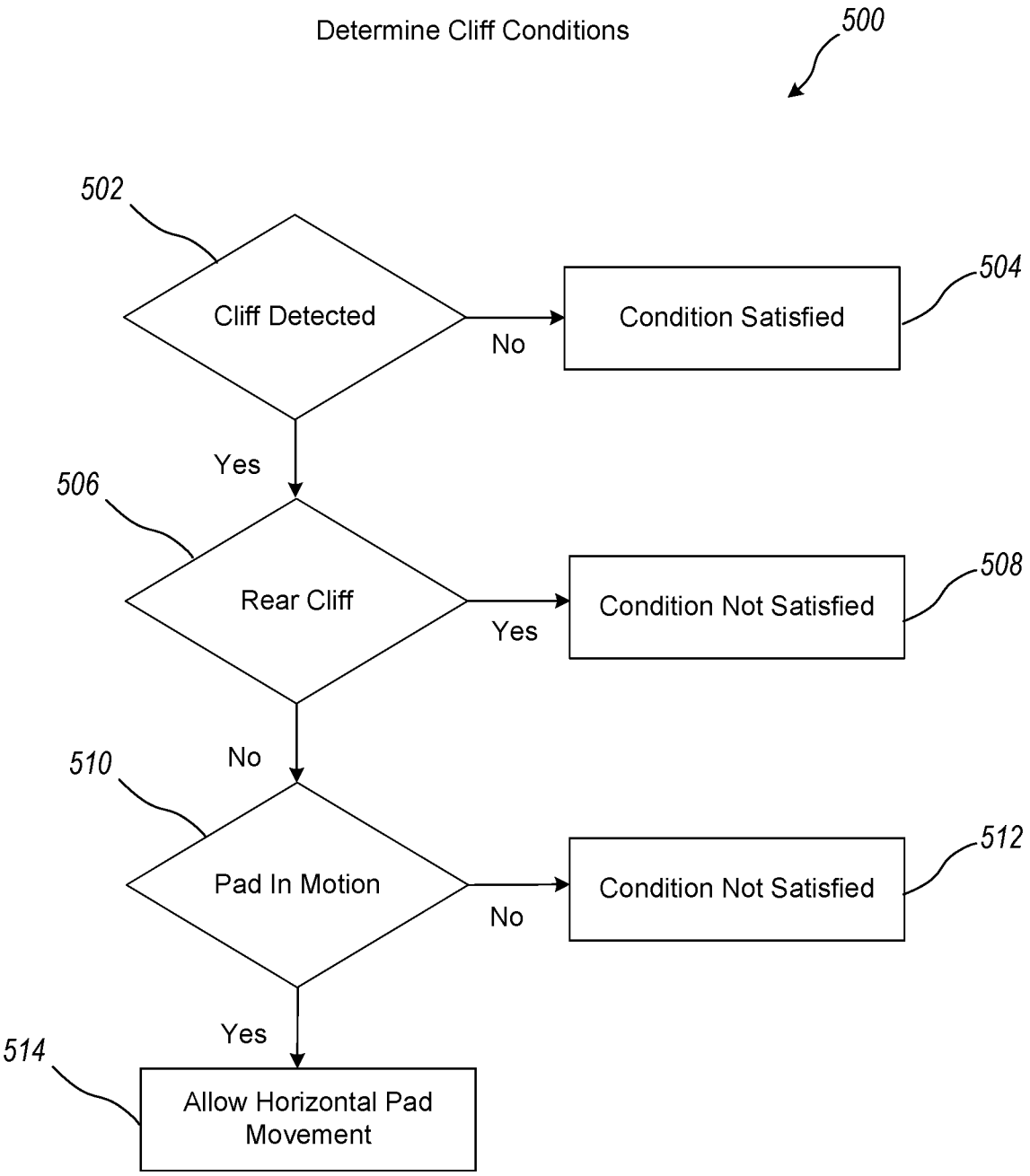
FIG. 5 illustrates a schematic view of a method of operating one or more systems or devices discussed herein.

FIG. 4 illustrates a schematic view of a method of operating one or more systems or devices discussed herein. The method 400 can be a method of moving a mopping pad assembly based on one or more movement conditions. Other examples of the method 400 are discussed below. The steps or operations of the method 400 are illustrated in a particular order for convenience and clarity; many of the discussed operations can be performed in a different sequence or in parallel without materially impacting other operations. The method 400 as discussed includes operations performed by multiple different actors, devices, and/or systems. It is understood that subsets of the operations discussed in the method 400 can be attributable to a single actor, device, or system could be considered a separate standalone process or method. The above considerations can apply to additional methods discussed further below.

The method 400 can begin at step 402, where a mobile cleaning robot can navigate (or move) within an environment. For example, the robot 100 can navigate or move within the environment 20, such as during the performance of one or more cleaning missions. At step 404, it can be determined whether a movement condition is satisfied. For example, the controller 111 can determine, such as based on one or more signals from one or more sensors of the robot 100, whether the movement condition is satisfied. Various examples of movement conditions are discussed below. When the movement condition is not satisfied, movement of the mopping pad tray (e.g., the pad tray 141) can be prevented, inhibited, or interrupted. For example, the controller 111 can operate the brake 129 to limit or prevent movement of the pad assembly 108.

Also, when the movement condition is not satisfied, or one or more behaviors of the robot can be adjusted at step 406. For example, the robot 100 can navigate to a different location in the environment. When the movement condition is satisfied, a mopping pad tray of the mobile cleaning robot can be moved at step 408. For example, the pad assembly 108 of the robot 100 can be moved between a stored position and a cleaning position.

The movement condition can optionally include one or more movement conditions or a set of movement conditions. For example, the controller 111 can determine, such as using the sensors 128 or a current sensors of the motors 116 of the drive wheels 118, whether the mobile cleaning robot 100 is moving within the environment. One or more of these determinations can be used to determine whether to move the pad assembly 108. For example, the controller 111 can inhibit or interrupt movement of the pad assembly 108 when the robot 100 is determined to be moving.

Also, the controller 111 can determine whether a space to a rear of the body 102 of the mobile cleaning robot 100 is clear of clutter based on a location of the mobile cleaning robot in the environment 40 and based on a map of the environment 40. The controller 111 can inhibit or interrupt movement of the pad assembly 108 when it is determined that the region or location behind the robot 100 is not free of clutter. It can be determined that the space is free of clutter when a space to the rear of the body 102 is determined to be free of obstacles that can be detected by the robot 100 such as by using the image capture device 140 or other sensors of the robot 100 or by referencing locations of previously detected of obstacles and clutter on the map of the environment. For movement to proceed, the space that is clear behind the robot 100 can be between 10 centimeters and 40 centimeters. In some examples, the space for the robot to proceed (or move the pad assembly 108) can be about half a diameter of the robot 100, or about 15 to 20 centimeters.

Optionally, it can be determined whether the robot 100 has vacuumed the space behind the robot 100. For example, the controller 111 can determine whether a space to a rear of the body 102 of the mobile cleaning robot 100 has been vacuumed based on a location of the mobile cleaning robot in the environment 40, based on a map of the environment 40, or based on stored mission details. The controller 111 can inhibit or interrupt movement of the pad assembly 108 when it is determined that the region or location behind the robot 100 is not space that has been recently or previously vacuumed.

Optionally, it can be determined whether the robot 100 has recently vacuumed the space to be mopped. The controller 111 can inhibit or interrupt movement of the pad assembly 108 when it is determined that the region or location to be mopped is not recently or previously vacuumed space. Ensuring that the mopping pad assembly 108 will engage a previously vacuumed floor surface of the environment can help limit contact between the mopping pad assembly 108 and debris, which can help to prolong a cleaning ability of the mopping pad assembly and can help to limit pushing or carrying debris within the environment.

Another movement condition can be confirming that the pad assembly 108 has not stalled or is not experiencing a stall condition. For example, the controller 111 can determine whether the pad assembly 108 has stalled based on a signal from the encoder connected to the pad assembly 108. The controller 111 can compare the encoder signal to a pad assembly drive signal to determine whether the pad assembly 108 has stalled. Also, a signal from a current sensor of the pad assembly 108 can be used to determine whether the pad assembly 108 has stalled. Various other conditions can be used by the controller 111 to determine whether or not the pad assembly 108 can be moved, as discussed in further detail below.

The method 500 can be a method of determining whether a movement condition is satisfied such that the pad assembly or pad tray can be moved. For example, the method 500 can be a method of determining cliff conditions. The method 500 can be an independent method or can be a portion or step of any method discussed above or below, such as step 404 of the method 400.

The method 500 can begin at step 502, where it can be determined whether a cliff is detected. For example, the controller 111 can receive signals from the sensors 128 to determine whether a cliff is in the proximity of the robot 100. A cliff can be any significant drop in elevation from a floor surface (e.g., the floor surface 50 of the environment 40) on which the robot 100 is resting. For example, a cliff can be a stair or a step downward between rooms. When no cliff is detected, at step 504, the movement condition can be satisfied and the controller 111 can move the mopping pad assembly 108.

When a cliff is detected, it can then be determined whether the cliff is a rear cliff at step 506. When the cliff is a rear cliff, the movement condition is not satisfied, at step 508. For example, when the controller 111 receives signals from the sensors 128 located at a rear portion of the robot 100 indicating that a cliff is present, the controller 111 can determine that a rear cliff is present. When such a detection of a rear cliff is made, it can be determined that the movement condition is not satisfied at step 508. In such a case, movement of the pad assembly 108 can be inhibited, interrupted, or prevented, at least until no rear cliff is detected. Limiting pad movements during detection of a rear cliff can help the robot 100 complete a higher percentage of its missions.

When it is determined, e.g., by the controller 111, that a rear cliff is not detected, it can be determined whether the mopping pad tray is in motion at step 510. For example, the controller 111 can receive a signal, such as from an encoder of the robot 100, which can be used by the controller 111 to determine that the pad assembly 108 is moving or is about to move. When it is determined that the pad assembly 108 is not already in motion, the condition is not satisfied at step 512 and movement of the pad assembly 108 can be inhibited, interrupted, or prevented, at least until no cliff is detected.

When it is determined that the pad assembly 108 is already in motion and that the cliff is not a rear cliff (e.g., the cliff is a front cliff or a side cliff), at step 514, movement of the pad assembly 108 can be limited to only horizontal movement of the pad assembly 108. For example, if it is determined by the controller 111 that the pad assembly 108 is moving toward the cleaning position and the pad assembly 108 has already moved through the vertical portion of the movement, the controller 111 can allow the pad assembly 108 to move horizontally to the cleaning position. Similarly, if it is determined by the controller 111 that the pad assembly 108 is moving toward the stored position and the pad assembly 108 has already moved through the vertical portion of the movement, the controller 111 can allow the pad assembly 108 to move horizontally to the stored position. Allowing some horizontal movement of the pad assembly 108 relative to a body of the robot 100 and limiting vertical movement of the pad assembly 108 relative to a body of the robot when a front or side cliff is detected can help the robot 100 complete a higher percentage of its missions while allowing the robot 100 to operate efficiently.

Figure 6:
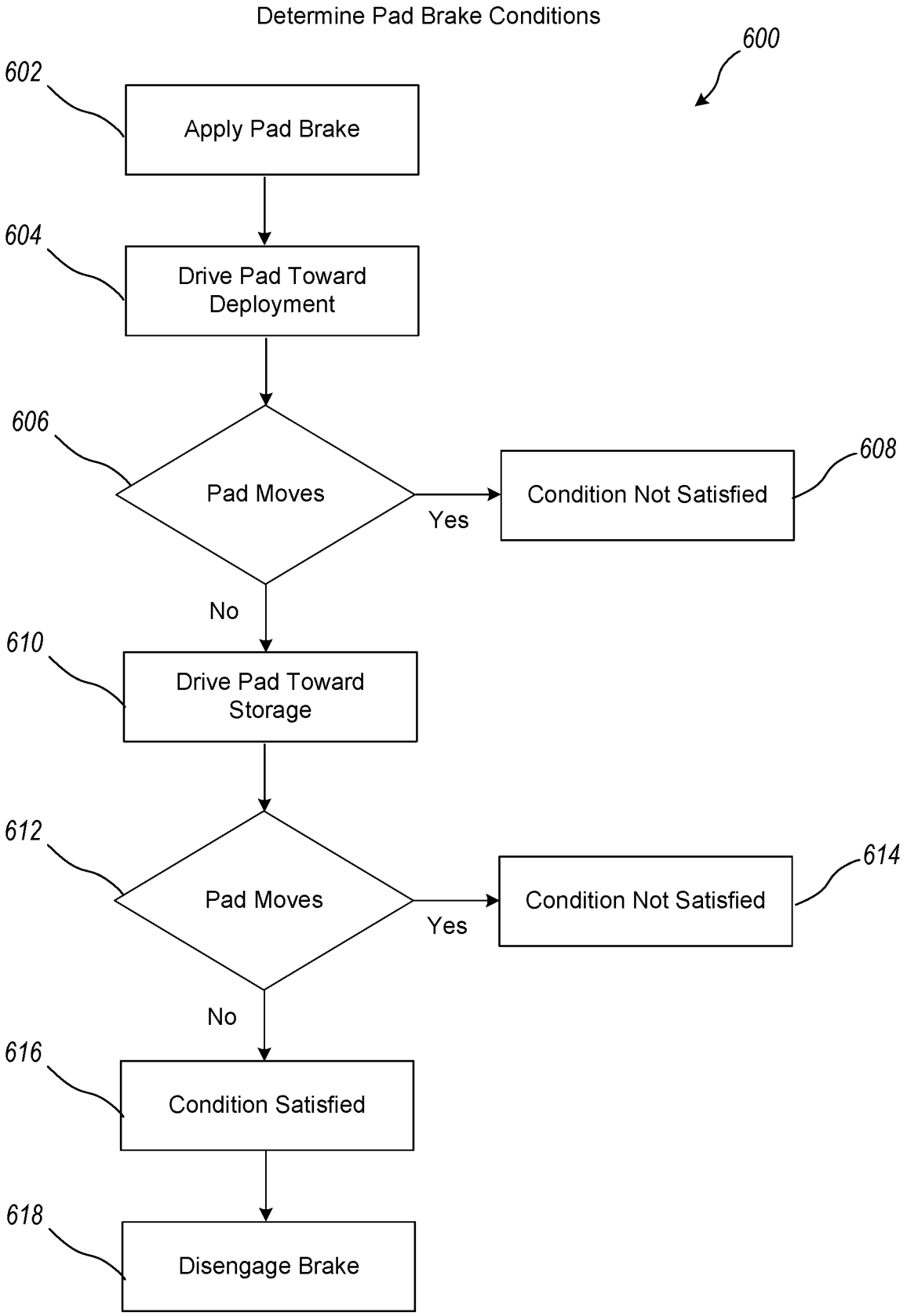
FIG. 6 illustrates a schematic view of a method of operating one or more systems or devices discussed herein.

FIG. 6 illustrates a schematic view of a method 600 of operating one or more systems or devices discussed herein. For example, the method 600 can be a method of determining pad brake conditions. The method 600 can be an independent method or can be a portion or step of any method discussed above or below, such as step 404 of the method 400.

The method 600 can begin at step 602 where a pad brake can be applied to the pad assembly. For example, the controller 111 can operate the brake 129 to activate and engage the pad assembly 108. At step 604 the pad tray of the pad assembly 108 can be driven to move towards deployment, such as toward the cleaning position. At step 606 it can be determined whether the pad assembly moves following the instruction to drive the pad assembly. For example, the controller 111 can receive a signal from the encoder to determine whether the pad assembly 108 has moved in response to the drive signal. If it is determined that the pad assembly 108 moves, the movement condition is not satisfied, at step 608. In such a case, operation of the pad assembly 108 can be limited by the controller 111 and the controller 111 can produce an alert.

If the pad assembly 108 does not move, the pad assembly 108 can be driven toward the storage position. Then, at step 612 it can be determined whether the pad assembly moves following the instruction to drive the pad assembly. For example, the controller 111 can receive a signal from the encoder to determine whether the pad assembly 108 has moved in response to the drive signal. If it is determined that the pad assembly 108 moves, the movement condition is not satisfied at step 614. In such a case, operation of the pad assembly 108 can be limited by the controller 111 and the controller 111 can produce an alert. If the pad assembly does not move, the movement condition can be satisfied at step 616 and the brake (e.g., the brake 129) can be released at step 618. Optionally, the brake 129 can be released following the step 606 and the step 610 to allow the pad assembly 108 the freedom to move within its normal range of operation during testing of the pad brake 129.

Figure 7:
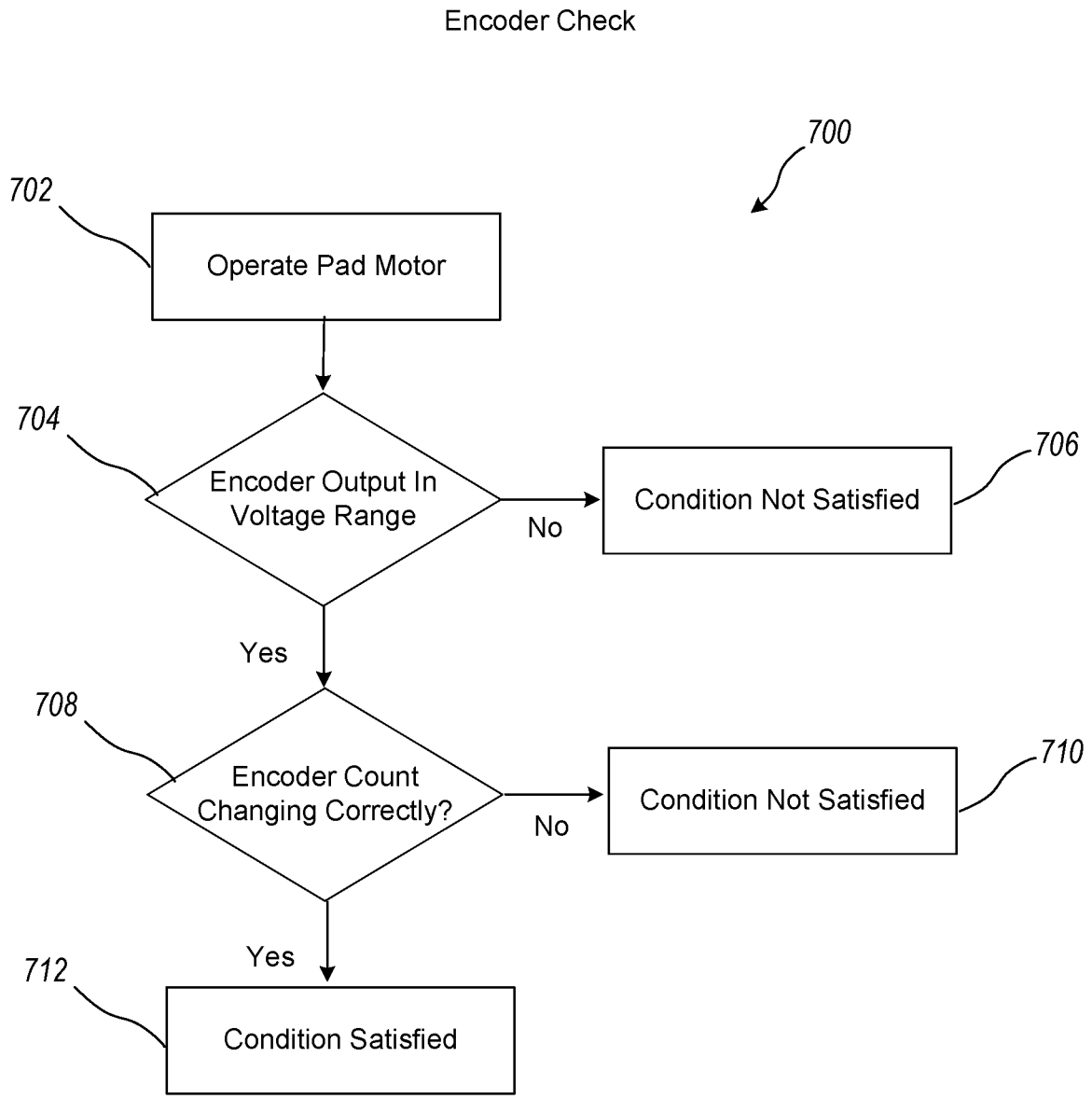
FIG. 7 illustrates a schematic view of a method of operating one or more systems or devices discussed herein.

FIG. 7 illustrates a schematic view of a method of operating one or more systems or devices discussed herein. For example, the method 700 can be a method of determining whether a pad motor encoder connected to a pad drive motor is operating in a specified manner. The method 700 can be an independent method or can be a portion or step of any method discussed above or below, such as step 404 of the method 400.

The method 700 can begin at step 702 where the pad motor can be operated (such as to drive the pad tray of the pad assembly 108). At step 704 it can be determined whether an output signal of the encoder is within a predetermined voltage range. For example, the encoder can be configured so that it operates within a range less than a full range of its standard voltage range, such as between 10 percent and 90 percent. Then, when the controller 111 receives the encoder signal, the controller 111 can determine whether the voltage is outside the operational range (e.g., below 10 percent or above 90 percent). When the voltage is outside the operational range, it can be determined that the movement condition is not met, at step 706 and movement of the pad assembly 108 can be inhibited or interrupted. Optionally, when the voltage range is outside of the operating range, the controller 111 can determine whether a short exists and can produce an alert when there is a short of the encoder. Optionally, the signal can be a signal varying in current.

The controller 111 can also compare the encoder signal to stored values of the encoder, which can be received from factory testing or from a fleet of robots, such as from the cloud computing system 306. The controller 111 or the cloud computing system 306 can compare the encoder signals to determine a health or operational status of the encoder of the robot 100, such as to determine whether the encoder is failing or has failed.

If it is determined (e.g., by the controller 111) that the encoder signal is within the normal operating range, it can be determined whether the encoder count is correct at step 708. The encoder count can be a number of counts of movement or counts of rotation of a motor that drives the pad assembly 108. The controller 111 can deduce or determine how far the pad assembly 108 has moved based on the number of counts. An absolute value can optionally be used.

When the motor is driven, the controller 111 can receive a signal from the encoder to determine the encoder count. When the motor is driven for a period of time, the controller 111 can compare an expected count for the given period of time to a calculated, received, or determined count. If the determined count does not match the expected count, it can be determined that the movement condition is not satisfied at step 710 and movement of the pad assembly 108 can be inhibited or interrupted. Optionally, an alert can be produced indicating that there is a problem with the drive system of the pad assembly 108 or the encoder, such as a stall condition. If the count is as expected or within a normal range or tolerance, the condition can be satisfied at step 712.

The counts can be observed over multiple time frames or under different circumstances. For example, the controller 111 can check the expected count against the received count over a short period of time (e.g., 1 second or less) at any time during movement of the pad assembly 108, such as to help detect any slippage, stalls, or other errors. Optionally, the controller 111 can check the expected count against the received count over a longer period of time (e.g., 10 seconds or more) during a full range of motion of the pad assembly 108 or an operational test thereof, such as to help detect any slippage, stalls, or other errors.

The count can be used in other ways to determine if the motor or encoder are operating properly. For example, the lowest count can be set to a position of the pad assembly 108 past the stored position and the highest count can be set to a position of the pad assembly 108 past the deployed or cleaning position. Optionally, the normal range can be set to about 30 degrees and 330 degrees of rotation of the encoder such that a reading below 30 degrees or above 330 degrees can indicate that the pad assembly 108 has moved beyond its normal operating range. This can allow the controller 111 to determine when the pad assembly 108 has improperly moved past the stored position or has moved improperly past the cleaning position. In either situation, the controller 111 can limit or inhibit further movement of the pad assembly 108 or can produce an alert.

Figure 8:
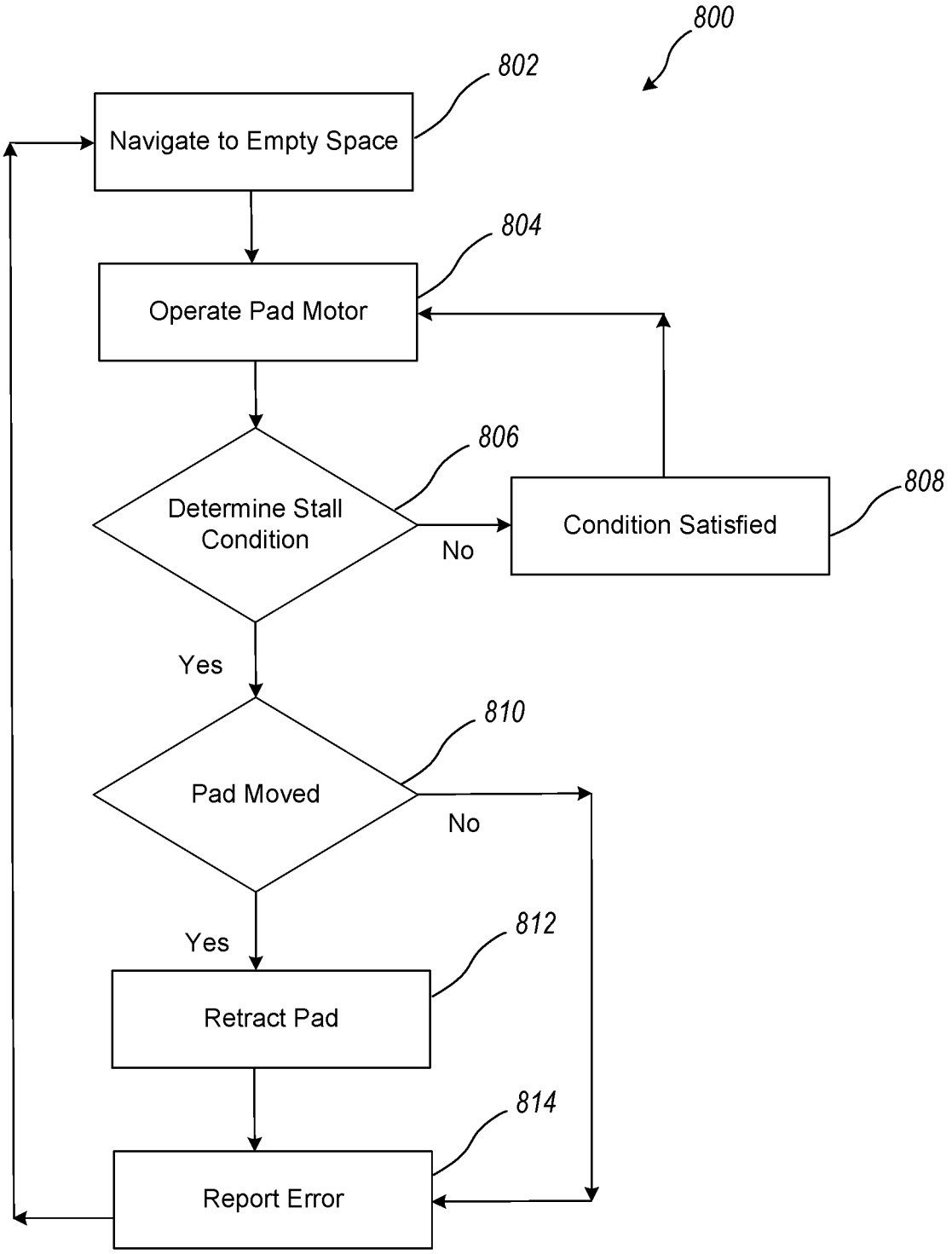
FIG. 8 illustrates a schematic view of a method of operating one or more systems or devices discussed herein.

FIG. 8 illustrates a schematic view of a method of operating one or more systems or devices discussed herein. For example, the method 800 can be a method of navigating a robot to a space where the pad assembly can be moved. The method 800 can be an independent method or can be a portion or step of any method discussed above or below, such as step 404 of the method 400.

The method 800 can begin at step 802 where the robot can be navigated to empty space. The controller 111 can use a map of the environment along with data collected from sensors (e.g., from the bump sensors 139 and the image capture device 140) to determine which grid cells or locations on the map are free of clutter. It can be determined that the space is free of clutter when a space to the rear of the body 102 is determined to be free of obstacles that can be detected by the robot 100, as discussed above. When the controller 111 determines that the space is free of clutter, the pad motor can be operated (e.g., by the controller 111) at step 804.

At step 806 it can be determined whether a stall condition of the sensors 128 exists. For example, the controller 111 can use signals from the pad assembly 108 such as the motor encoder or a current sensor of the motor to determine whether the pad assembly 108 is in a stall condition. If the pad assembly 108 is not stalled, the condition can be satisfied at mass storage 808 and movement of the pad assembly 108 can continue. Optionally, steps 804 through 808 can be repeated so long as the pad assembly 108 is moving.

If a stall condition is detected, it can be determined whether the pad has moved at step 810, such as by the controller 111 based on one or more signals (e.g., the encoder signal). If it is determined that the pad has moved, the pad assembly 108 can be retracted at step 812 and an error can be reported at step 814. If it is determined that the pad has not moved, the error can be reported at step 814. Thereafter, the step 802 can be repeated where the robot 100 can be navigated to a different empty space to attempt to move the pad again. Upon a determination of multiple failures, the controller 111 can produce an additional or different alert indicating the failures and the controller 111 can inhibit further movement of the pad assembly 108.

Optionally, the controller 111 can move the pad assembly 108 in certain circumstances. For example, the pad assembly 108 can be moved to the stored position when the robot 100 is first started up. Also, the pad assembly 108 can be moved to the stored position when the robot 100 is performing a docking routine. Further, the pad assembly 108 can be moved to the stored position when the robot 100 is paused and away from the dock. This can help to prevent the pad assembly 108 from being stuck in the cleaning position in case the battery becomes depleted while the robot 100 is away from the dock. Also, the pad assembly 108 can be moved to the storage position before evacuation of the debris bin by the docking station.

The controller 111 can also inhibit or interrupt sending of a signal to move the pad assembly 108 for other reasons, such as when the controller 111 determines that the robot 100 is on a carpeted surface, when the pad assembly 108 is already moving, or when the pad assembly 108 is already in the desired position. Though a standard rule can be to inhibit or interrupt movement of the pad assembly 108 when the robot 100 is moving, an exception can be a movement routine performed by the robot 100 during movement of the pad from the stored position and the cleaning position or from the cleaning position to the stored position, as discussed below with respect to FIGS. 9A-9D.

FIGS. 9A-9D illustrate perspective views of a mobile cleaning robot 900 in a moving relative to a floor surface during movement of a pad assembly 908. FIDS. 9A and 9D also show position P and directions D1 and D2. FIGS. 9A-9D are discussed together below.

The mobile cleaning robot 900 can be similar to the robot 100 discussed above in that the mobile cleaning robot 900 can include a body 902 and a pad assembly 908 including a pad tray 941 movable relative to the body 902 via arms 906. FIGS. 9A-9D show how the mobile cleaning robot 900 can move relative to the floor 50 while the pad tray 941 moves relative to the body 902.

Figure 9A:
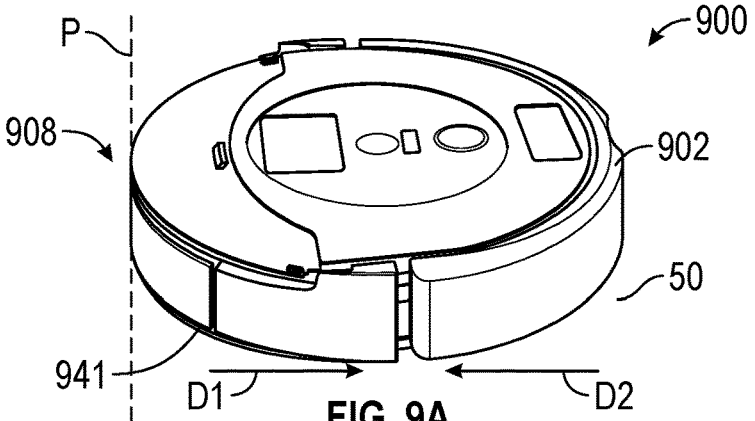
FIG. 9A illustrates a perspective view of a mobile cleaning robot in a first condition.
Figure 9B:
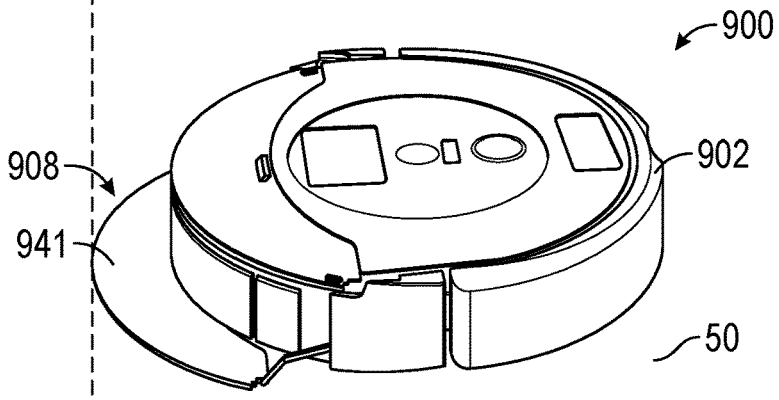
FIG. 9B illustrates a perspective view of a mobile cleaning robot in a second condition.
Figure 9C:
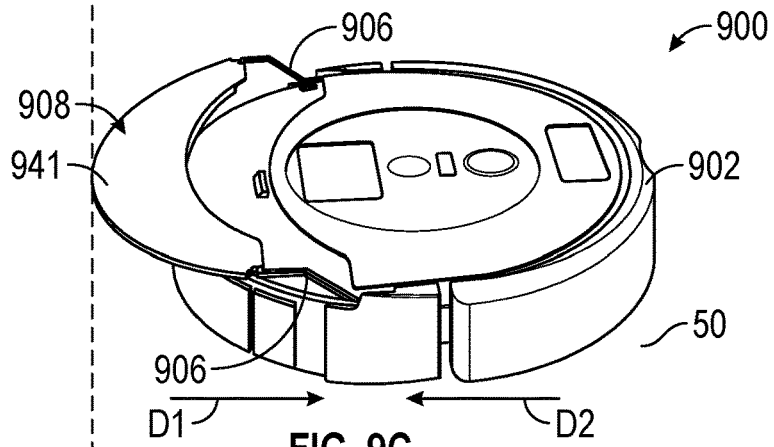
FIG. 9C illustrates a perspective view of a mobile cleaning robot in a third condition.

More specifically, as shown in FIG. 9A, the tray 941 can be in a cleaning position and a rear portion of the body 902 can be aligned with position P. When a controller (e.g., the controller 111) moves the pad tray 941 toward the stored position, the controller can move the body 902. As shown in FIG. 9B, as the pad tray extends in direction D2, the controller 111 can move the body 902 in direction D1 such that the pad tray remains at the position P. The pad tray 941 can move upward, as shown in FIG. 9C, such that a rear portion of the pad tray 941 is still at the position P.

Figure 9D:
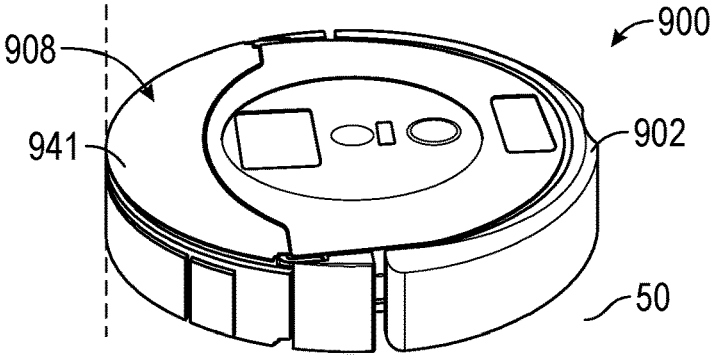
FIG. 9D illustrates a perspective view of a mobile cleaning robot in a fourth condition.

Then, as shown in FIG. 9D, as the pad tray 941 moves (horizontally) in direction D1 toward the stored position, the controller 111 can move the body 902 in the direction D2 such that when the pad tray 941 is fully stored, the rear portion of the pad tray and the rear portion of the body are at the position P. In this way, the mobile cleaning robot 900 can avoid moving any component rearward of the position P during moving of the pad tray 941 from the cleaning position to the stored position (or from the stored position to the cleaning position). This movement routine can help limit engagement between the pad tray 941 and clutter or obstacles within the environment 40 as the pad tray 941 is moved between the stored position and the cleaning position.

Figure 10:
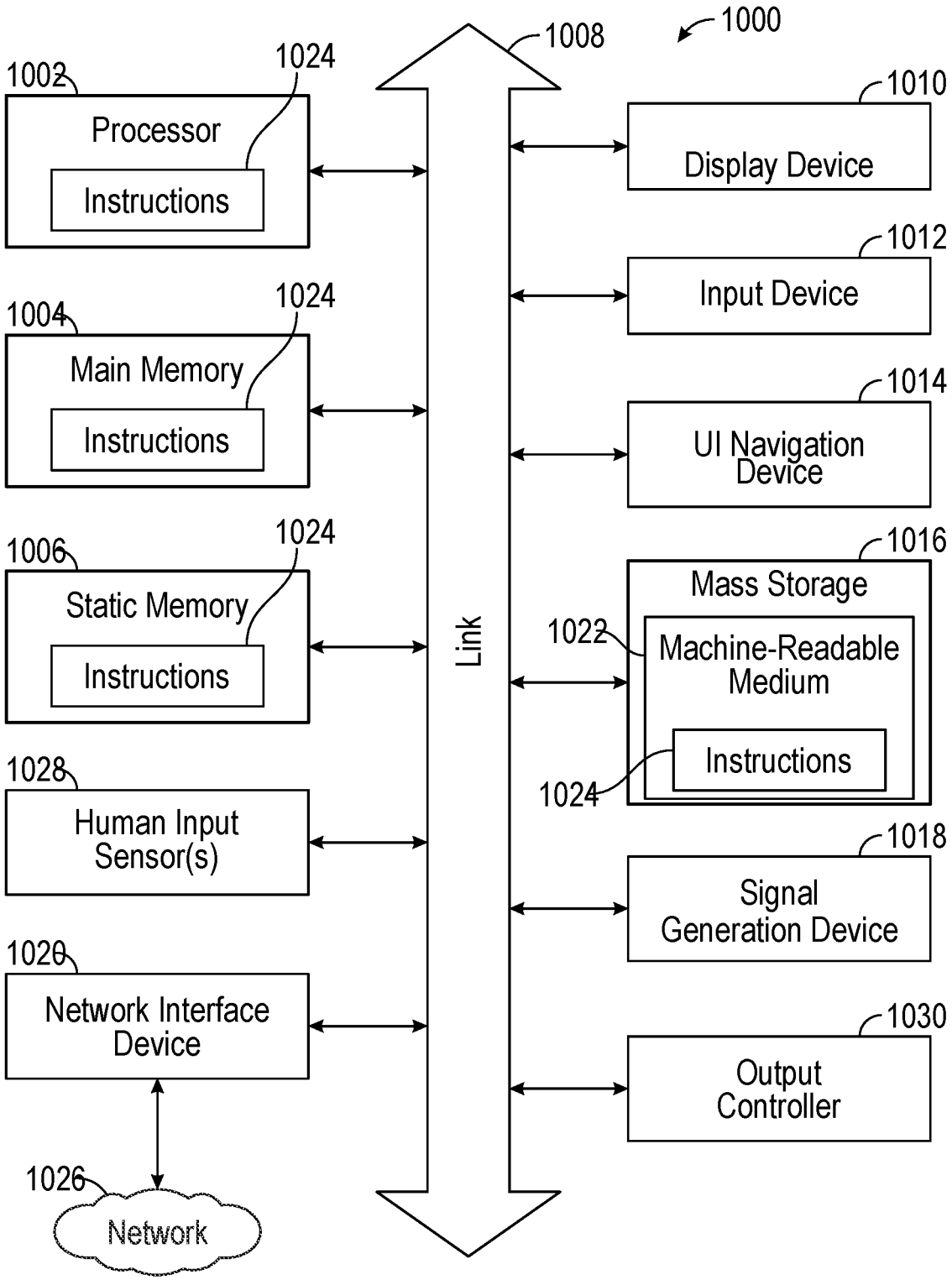
FIG. 10 illustrates a block diagram illustrating an example of a machine upon which one or more embodiments may be implemented.

FIG. 10 illustrates a block diagram of an example machine 1000 upon which any one or more of the techniques (e.g., methodologies) discussed herein may perform. Examples, as described herein, may include, or may operate by, logic or a number of components, or mechanisms in the machine 1000. Circuitry (e.g., processing circuitry) is a collection of circuits implemented in tangible entities of the machine 1000 that include hardware (e.g., simple circuits, gates, logic, etc.). Circuitry membership may be flexible over time. Circuitries include members that may, alone or in combination, perform specified operations when operating. In an example, hardware of the circuitry may be immutably designed to carry out a specific operation (e.g., hardwired). In an example, the hardware of the circuitry may include variably connected physical components (e.g., execution units, transistors, simple circuits, etc.) including a machine readable medium physically modified (e.g., magnetically, electrically, moveable placement of invariant massed particles, etc.) to encode instructions of the specific operation. In connecting the physical components, the underlying electrical properties of a hardware constituent are changed, for example, from an insulator to a conductor or vice versa. The instructions enable embedded hardware (e.g., the execution units or a loading mechanism) to create members of the circuitry in hardware via the variable connections to carry out portions of the specific operation when in operation. Accordingly, in an example, the machine readable medium elements are part of the circuitry or are communicatively coupled to the other components of the circuitry when the device is operating. In an example, any of the physical components may be used in more than one member of more than one circuitry. For example, under operation, execution units may be used in a first circuit of a first circuitry at one point in time and reused by a second circuit in the first circuitry, or by a third circuit in a second circuitry at a different time. Additional examples of these components with respect to the machine 1000 follow.

In alternative embodiments, the machine 1000 may operate as a standalone device or may be connected (e.g., networked) to other machines. In a networked deployment, the machine 1000 may operate in the capacity of a server machine, a client machine, or both in server-client network environments. In an example, the machine 1000 may act as a peer machine in peer-to-peer (P2P) (or other distributed) network environment. The machine 1000 may be a personal computer (PC), a tablet PC, a set-top box (STB), a personal digital assistant (PDA), a mobile telephone, a web appliance, a network router, switch or bridge, or any machine capable of executing instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein, such as cloud computing, software as a service (SaaS), other computer cluster configurations.

The machine (e.g., computer system) 1000 may include a hardware processor 1002 (e.g., a central processing unit (CPU), a graphics processing unit (GPU), a hardware processor core, or any combination thereof), a main memory 1004, a static memory (e.g., memory or storage for firmware, microcode, a basic-input-output (BIOS), unified extensible firmware interface (UEFI), etc.) 1006, and mass storage 1008 (e.g., hard drive, tape drive, flash storage, or other block devices) some or all of which may communicate with each other via an interlink (e.g., bus) 1030. The machine 1000 may further include a display unit 1010, an alphanumeric input device 1012 (e.g., a keyboard), and a user interface (UI) navigation device 1014 (e.g., a mouse). In an example, the display unit 1010, input device 1012 and UI navigation device 1014 may be a touch screen display. The machine 1000 may additionally include a storage device (e.g., drive unit) 1008, a signal generation device 1018 (e.g., a speaker), a network interface device 1020, and one or more sensors 1016, such as a global positioning system (GPS) sensor, compass, accelerometer, or other sensor. The machine 1000 may include an output controller 1028, such as a serial (e.g., universal serial bus (USB), parallel, or other wired or wireless (e.g., infrared (IR), near field communication (NFC), etc.) connection to communicate or control one or more peripheral devices (e.g., a printer, card reader, etc.).

Registers of the processor 1002, the main memory 1004, the static memory 1006, or the mass storage 1008 may be, or include, a machine readable medium 1022 on which is stored one or more sets of data structures or instructions 1024 (e.g., software) embodying or utilized by any one or more of the techniques or functions described herein. The instructions 1024 may also reside, completely or at least partially, within any of registers of the processor 1002, the main memory 1004, the static memory 1006, or the mass storage 1008 during execution thereof by the machine 1000. In an example, one or any combination of the hardware processor 1002, the main memory 1004, the static memory 1006, or the mass storage 1008 may constitute the machine readable media 1022. While the machine readable medium 1022 is illustrated as a single medium, the term "machine readable medium" may include a single medium or multiple media (e.g., a centralized or distributed database, and/or associated caches and servers) configured to store the one or more instructions 1024.

The term "machine readable medium" may include any medium that is capable of storing, encoding, or carrying instructions for execution by the machine 1000 and that cause the machine 1000 to perform any one or more of the techniques of the present disclosure, or that is capable of storing, encoding or carrying data structures used by or associated with such instructions. Non-limiting machine readable medium examples may include solid-state memories, optical media, magnetic media, and signals (e.g., radio frequency signals, other photon based signals, sound signals, etc.). In an example, a non-transitory machine readable medium comprises a machine readable medium with a plurality of particles having invariant (e.g., rest) mass, and thus are compositions of matter. Accordingly, non-transitory machine-readable media are machine readable media that do not include transitory propagating signals. Specific examples of non-transitory machine readable media may include: non-volatile memory, such as semiconductor memory devices (e.g., Electrically Programmable Read-Only Memory (EPROM), Electrically Erasable Programmable Read-Only Memory (EEPROM)) and flash memory devices; magnetic disks, such as internal hard disks and removable disks; magneto-optical disks; and CD-ROM and DVD-ROM disks.

The instructions 1024 may be further transmitted or received over a communications network 1026 using a transmission medium via the network interface device 1020 utilizing any one of a number of transfer protocols (e.g., frame relay, internet protocol (IP), transmission control protocol (TCP), user datagram protocol (UDP), hypertext transfer protocol (HTTP), etc.). Example communication networks may include a local area network (LAN), a wide area network (WAN), a packet data network (e.g., the Internet), mobile telephone networks (e.g., cellular networks), Plain Old Telephone (POTS) networks, and wireless data networks (e.g., Institute of Electrical and Electronics Engineers (IEEE) 802.11 family of standards known as Wi-Fi®, IEEE 802.16 family of standards known as WiMax®), IEEE 802.15.4 family of standards, peer-to-peer (P2P) networks, among others. In an example, the network interface device 1020 may include one or more physical jacks (e.g., Ethernet, coaxial, or phone jacks) or one or more antennas to connect to the communications network 1026. In an example, the network interface device 1020 may include a plurality of antennas to wirelessly communicate using at least one of single-input multiple-output (SIMO), multiple-input multiple-output (MIMO), or multiple-input single-output (MISO) techniques. The term "transmission medium" shall be taken to include any intangible medium that is capable of storing, encoding or carrying instructions for execution by the machine 1000, and includes digital or analog communications signals or other intangible medium to facilitate communication of such software. A transmission medium is a machine readable medium.

NOTES AND EXAMPLES

The following, non-limiting examples, detail certain aspects of the present subject matter to solve the challenges and provide the benefits discussed herein, among others.

Example 1 is a method of operating a mobile cleaning robot, the method comprising: navigating the mobile cleaning robot within an environment; determining whether a movement condition is satisfied; and moving a mopping pad tray relative to a body of the mobile cleaning robot between a cleaning position and a stored position in response to receipt of a command to move the mopping pad tray when the movement condition is satisfied.

In Example 2, the subject matter of Example 1 includes, wherein determining whether the movement condition is satisfied includes detecting a rear cliff.

In Example 3, the subject matter of Example 2 includes, inhibiting or interrupting movement of the mopping pad tray when the rear cliff is detected.

In Example 4, the subject matter of Examples 2-3 includes, wherein moving the mopping pad tray between the cleaning position and the stored position includes moving the mopping pad tray in a horizontal direction relative to the body and a vertical direction relative to the body.

In Example 5, the subject matter of Example 4 includes, wherein determining whether the movement condition is satisfied includes detecting at least one of a front cliff or a side cliff.

In Example 6, the subject matter of Example 5 includes, inhibiting or interrupting vertical movement of the mopping pad tray when at least one of the front cliff is detected or the side cliff is detected; and allowing horizontal movement of the mopping pad tray when at least one of the front cliff is detected or the side cliff is detected.

In Example 7, the subject matter of Example 6 includes, operating a vacuum system of the mobile cleaning robot when the mopping pad is in the cleaning position.

In Example 8, the subject matter of Examples 1-7 includes, wherein determining whether the movement condition is satisfied includes determining whether a set of movement conditions is met.

In Example 9, the subject matter of Examples 1-8 includes, wherein determining whether the movement condition is satisfied includes confirming that a motor encoder connected to a pad drive motor is operating in a specified manner.

In Example 10, the subject matter of Examples 1-9 includes, inhibiting or interrupting movement of the mopping pad tray when the movement condition is not satisfied.

In Example 11, the subject matter of Examples 1-10 includes, wherein inhibiting or interrupting movement of the mopping pad tray includes applying a brake to a drive train that drives the mopping pad tray.

In Example 12, the subject matter of Examples 1-11 includes, wherein the stored position of the mopping pad tray is on top of the body and wherein the cleaning position of the mopping pad tray is at least partially under the body.

In Example 13, the subject matter of Examples 1-12 includes, wherein determining whether the movement condition is satisfied includes determining whether a space to a rear of the body of the mobile cleaning robot is clear of clutter based on a location of the mobile cleaning robot in the environment and based on a map of the environment.

In Example 14, the subject matter of Examples 1-13 includes, wherein determining whether the movement condition is satisfied includes determining whether the mobile cleaning robot is moving within the environment.

Example 15 is a non-transitory machine-readable medium including instructions, for operating a mobile cleaning robot, which when executed by a machine, cause the machine to: navigate the mobile cleaning robot within an environment; determine whether a movement condition is satisfied; and move a mopping pad tray relative to a body of the mobile cleaning robot between a cleaning position and a stored position in response to receipt of a command to move the mopping pad tray when the movement condition is satisfied.

In Example 16, the subject matter of Example 15 includes, the instructions to further cause the machine to: detect a rear cliff; and determine whether the movement condition is satisfied based on detection of the rear cliff.

In Example 17, the subject matter of Example 16 includes, the instructions to further cause the machine to: inhibit or interrupt movement of the mopping pad tray when the rear cliff is detected.

In Example 18, the subject matter of Example 17 includes, wherein moving the mopping pad tray between the cleaning position and the stored position includes moving the mopping pad tray in a horizontal direction relative to the body and a vertical direction relative to the body.

In Example 19, the subject matter of Example 18 includes, the instructions to further cause the machine to:

detect at least one of a front cliff or a side cliff; and determine whether the movement condition is satisfied based on detection of the front cliff or the side cliff.

In Example 20, the subject matter of Example 19 includes, the instructions to further cause the machine to: inhibit or interrupt vertical movement of the mopping pad tray when at least one of the front cliff is detected or the side cliff is detected; and allow horizontal movement of the mopping pad tray when at least one of the front cliff is detected or the side cliff is detected.

In Example 21, the subject matter of Examples 18-20 includes, the instructions to further cause the machine to: detect a stall condition of the mopping pad tray; and determine whether the movement condition is satisfied based on detection of the stall condition.

In Example 22, the subject matter of Example 21 includes, the instructions to further cause the machine to: inhibit or interrupt movement of the mopping pad tray when the stall condition is detected; determine a location of the mobile cleaning robot in the environment; navigate the mobile cleaning robot to a new location in the environment; and move the mopping pad tray between the cleaning position and the stored position after navigating to the new location.

Example 23 is at least one machine-readable medium including instructions that, when executed by processing circuitry, cause the processing circuitry to perform operations to implement of any of Examples 1-22.

Example 24 is an apparatus comprising means to implement of any of Examples 1-22.

Example 25 is a system to implement of any of Examples 1-22.

Example 26 is a method to implement of any of Examples 1-22.

In Example 27, the apparatuses, systems, or methods of any one or any combination of Examples 1-26 can optionally be configured such that all elements or options recited are available to use or select from.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim.

The above description is intended to be illustrative, and not restrictive. For example, the above-described examples (or one or more aspects thereof) can be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features can be grouped together to streamline the disclosure. This should not be interpreted as intending that an unclaimed disclosed feature is essential to any claim. Rather, inventive subject matter can lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The invention claimed is:

1. A method of operating a mobile cleaning robot, the method comprising:

navigating the mobile cleaning robot within an environment;

determining whether a movement condition is satisfied including detecting a rear cliff, and detecting at least one of a front cliff or a side cliff;

moving a mopping pad tray relative to a body of the mobile cleaning robot between a cleaning position and a stored position in response to receipt of a command to move the mopping pad tray when the movement condition is satisfied, wherein moving the mopping pad tray between the cleaning position and the stored position includes moving the mopping pad tray in a horizontal direction relative to the body and a vertical direction relative to the body;

inhibiting or interrupting vertical movement of the mopping pad tray when at least one of the front cliff is detected or the side cliff is detected; and allowing horizontal movement of the mopping pad tray when at least one of the front cliff is detected or the side cliff is detected.

2. The method of claim 1, further comprising:

inhibiting or interrupting movement of the mopping pad tray when the rear cliff is detected.

3. The method of claim 1, further comprising:

operating a vacuum system of the mobile cleaning robot when the mopping pad tray is in the cleaning position.

4. The method of claim 1, wherein determining whether the movement condition is satisfied includes determining whether a set of movement conditions is met.

5. The method of claim 1, wherein determining whether the movement condition is satisfied includes confirming that a motor encoder connected to a pad drive motor is operating in a specified manner.

6. The method of claim 1, further comprising:

inhibiting or interrupting movement of the mopping pad tray when the movement condition is not satisfied.

7. The method of claim 1, wherein inhibiting or interrupting movement of the mopping pad tray includes applying a brake to a drive train that drives the mopping pad tray.

8. The method of claim 1, wherein the stored position of the mopping pad tray is on top of the body and wherein the cleaning position of the mopping pad tray is at least partially under the body.

9. The method of claim 1, wherein determining whether the movement condition is satisfied includes determining whether a space to a rear of the body of the mobile cleaning robot is clear of clutter based on a location of the mobile cleaning robot in the environment and based on a map of the environment.

10. The method of claim 1, wherein determining whether the movement condition is satisfied includes determining whether the mobile cleaning robot is moving within the environment.

11. A non-transitory machine-readable medium including instructions, for operating a mobile cleaning robot, which when executed by a machine, cause the machine to:

navigate the mobile cleaning robot within an environment;

determine whether a movement condition is satisfied;

move a mopping pad tray relative to a body of the mobile cleaning robot between a cleaning position and a stored position in response to receipt of a command to move the mopping pad tray when the movement condition is satisfied, wherein moving the mopping pad tray between the cleaning position and the stored position includes moving the mopping pad tray in a horizontal direction relative to the body and a vertical direction relative to the body;

detect a rear cliff;

determine whether the movement condition is satisfied based on detection of the rear cliff;

inhibit or interrupt movement of the mopping pad tray when the rear cliff is detected;

detect at least one of a front cliff or a side cliff;

determine whether the movement condition is satisfied based on detection of the front cliff or the side cliff;

inhibit or interrupt vertical movement of the mopping pad tray when at least one of the front cliff is detected or the side cliff is detected; and allow horizontal movement of the mopping pad tray when at least one of the front cliff is detected or the side cliff is detected.

12. The non-transitory machine-readable medium of claim 11, the instructions to further cause the machine to:

detect a stall condition of the mopping pad tray; and determine whether the movement condition is satisfied based on detection of the stall condition.

13. The non-transitory machine-readable medium of claim 12, the instructions to further cause the machine to:

inhibit or interrupt movement of the mopping pad tray when the stall condition is detected;

determine a location of the mobile cleaning robot in the environment;

navigate the mobile cleaning robot to a new location in the environment; and move the mopping pad tray between the cleaning position and the stored position after navigating to the new location.

14. A non-transitory machine-readable medium including instructions, for operating a mobile cleaning robot, which when executed by a machine, cause the machine to:

navigate the mobile cleaning robot within an environment;

determine whether a movement condition is satisfied;

move a mopping pad tray relative to a body of the mobile cleaning robot between a cleaning position and a stored position in response to receipt of a command to move the mopping pad tray when the movement condition is satisfied, wherein moving the mopping pad tray between the cleaning position and the stored position includes moving the mopping pad tray in a horizontal direction relative to the body and a vertical direction relative to the body;

detect a rear cliff;

determine whether the movement condition is satisfied based on detection of the rear cliff;

inhibit or interrupt movement of the mopping pad tray when the rear cliff is detected;

detect a stall condition of the mopping pad tray;

determine whether the movement condition is satisfied based on detection of the stall condition;

inhibit or interrupt movement of the mopping pad tray when the stall condition is detected;

determine a location of the mobile cleaning robot in the environment;

navigate the mobile cleaning robot to a new location in the environment; and move the mopping pad tray between the cleaning position and the stored position after navigating to the new location.

15. The non-transitory machine-readable medium of claim 14, the instructions to further cause the machine to:

detect at least one of a front cliff or a side cliff; and determine whether the movement condition is satisfied based on detection of the front cliff or the side cliff.

16. The non-transitory machine-readable medium of claim 15, the instructions to further cause the machine to:

inhibit or interrupt vertical movement of the mopping pad tray when at least one of the front cliff is detected or the side cliff is detected; and allow horizontal movement of the mopping pad tray when at least one of the front cliff is detected or the side cliff is detected.

* * * * *